United States Patent [19]

Kawai

[11] 4,015,428

[45] Apr. 5, 1977

[54] FUEL CONTROL APPARATUS FOR AN AUTOMOBILE ENGINE EQUIPPED WITH AN ELECTRONICALLY CONTROLLED FUEL INJECTION SYSTEM AND AN EXHAUST GAS PURIFYING SYSTEM

[75] Inventor: Mitsuo Kawai, Toyoda, Japan

[73] Assignee: Toyota Jidosha Kogyo Kabushiki Kaisha, Toyoda, Japan

[22] Filed: July 15, 1974

[21] Appl. No.: 488,660

[30] Foreign Application Priority Data

Mar. 13, 1974 Japan ..... 49-17390

[52] U.S. Cl. ..... 60/277; 60/285; 123/198 DB; 123/198 F

[51] Int. Cl.[2] ..... F02B 75/10

[58] Field of Search ... 123/140 MC, 32 EA, 198 DB, 123/198 F; 60/277, 285; 73/115, 116, 117.3, 346

[56] References Cited

UNITED STATES PATENTS

| | | | |
|---|---|---|---|
| 3,101,617 | 8/1963 | Brinson | 73/346 X |
| 3,472,068 | 10/1969 | List et al. | 60/277 X |
| 3,576,182 | 4/1971 | Howland | 123/140 MC X |
| 3,820,198 | 6/1974 | Scofield | 123/140 MC X |
| 3,851,469 | 12/1974 | Eichler et al. | 60/277 |
| 3,916,622 | 11/1975 | Gospodar | 73/346 X |

FOREIGN PATENTS OR APPLICATIONS

| | | | |
|---|---|---|---|
| 1,941,587 | 2/1971 | Germany | 73/346 |

*Primary Examiner*—C. J. Husar
*Assistant Examiner*—Tony M. Argenbright
*Attorney, Agent, or Firm*—Stevens, Davis, Miller & Mosher

[57] ABSTRACT

An improved fuel control apparatus for installation on an automobile engine equipped with an electronically controlled fuel injection system and a catalytic exhaust gas purifying system to prevent excess uncombusted fuel from being carried over into the catalytic purifier and burning therein with a resultant damage thereto. The apparatus essentially comprises a plurality of solenoid valves each associated with one of a plurality of fuel injection nozzles, a device for alternately energizing the solenoid valves to close to selectively stop the supply of fuel to one of the fuel injection nozzles upon elevation of the purifier temperature above a predetermined level, and a device for detecting the temperature of the catalytic purifier and transmitting only in case of elevation of the purifier temperature above a predetermined level a signal which enables the solenoid valve energizing device to function.

4 Claims, 4 Drawing Figures

FUEL CONTROL APPARATUS FOR AN AUTOMOBILE ENGINE EQUIPPED WITH AN ELECTRONICALLY CONTROLLED FUEL INJECTION SYSTEM AND AN EXHAUST GAS PURIFYING SYSTEM

This invention relates to a fuel control apparatus for an automobile engine and more particularly to a fuel control apparatus for an automobile engine provided with an electronically controlled fuel injection system and an exhaust gas purifying system.

There has hitherto been known an electronically controlled fuel injection system arranged for determining the optimum timing and duration of fuel injection into vehicular engine cylinders depending upon varying weather and vehicular operating conditions. The system is intended for supplying each engine cylinder with a constantly optimum quality of fuel-air mixture automatically adapted to such varying conditions to increase the combustion efficiency of the engine and enable the automobile to run smoothly at varying speeds. The system has, however, been unsatisfactory because any malfunction of the needle valve for any fuel injection nozzle lowers the performance of the engine seriously. The problem is more serious when the automobile is further equipped with a catalytic exhaust gas purifying system. If, due to rusting or any other cause, any needle valve fails to close properly and lets fuel flow into the corresponding engine cylinder when such fuel is not to be supplied thereinto, or if any engine cylinder misfires, an increased quantity of uncombusted fuel flows into the catalytic purifier and burns therein. The catalyst in the purifier is heated to an extremely high temperature, and the activity of the catalyst is impaired and the life thereof shortened considerably. In some worse cases, the purifier temperature becomes so high as to burn out the catalyst.

It is, therefore, an object of this invention to provide a fuel control apparatus for an automobile engine equipped with an electronically controlled fuel injection system and an exhaust gas purifying system, which apparatus is adapted to selectively discontinue the supply of fuel to a particular fuel injection nozzle for a certain period of time following any misfiring of an engine cylinder or cylinders, in order to prevent any excess of uncombusted fuel from being carried over into the exhaust gas purifying system to burn therein with a resultant damage thereto.

It is another object of this invention to provide a fuel control apparatus for an automobile engine equipped with an electronically controlled fuel injection system and an exhaust gas purifying system, which apparatus is adapted to selectively discontinue the supply of fuel to a particular fuel injection nozzle for a certain period of time following failure of its needle valve to close properly due to rusting or any other cause, in order to prevent any excess uncombusted fuel from flowing through an engine cylinder or cylinders into the exhaust gas purifying system to burn therein with a resultant damage thereto.

It is a further object of this invention to provide a fuel control apparatus for an automobile engine equipped with an electronically controlled fuel injection system and an exhaust gas purifying system, which apparatus is adapted to selectively discontinue the supply of fuel to a particular fuel injection nozzle for a certain period of time following failure thereof or misfiring of an engine cylinder or cylinders, while maintaining the supply of fuel to the other fuel injection nozzles, whereby one is permitted to continue driving the automobile as far as at least his destination with one or more engine cylinders left in their inoperative condition.

Other objects and features of this invention will become apparent from the following description of the preferred embodiments thereof and the accompanying drawings, in which.

Figure 1:
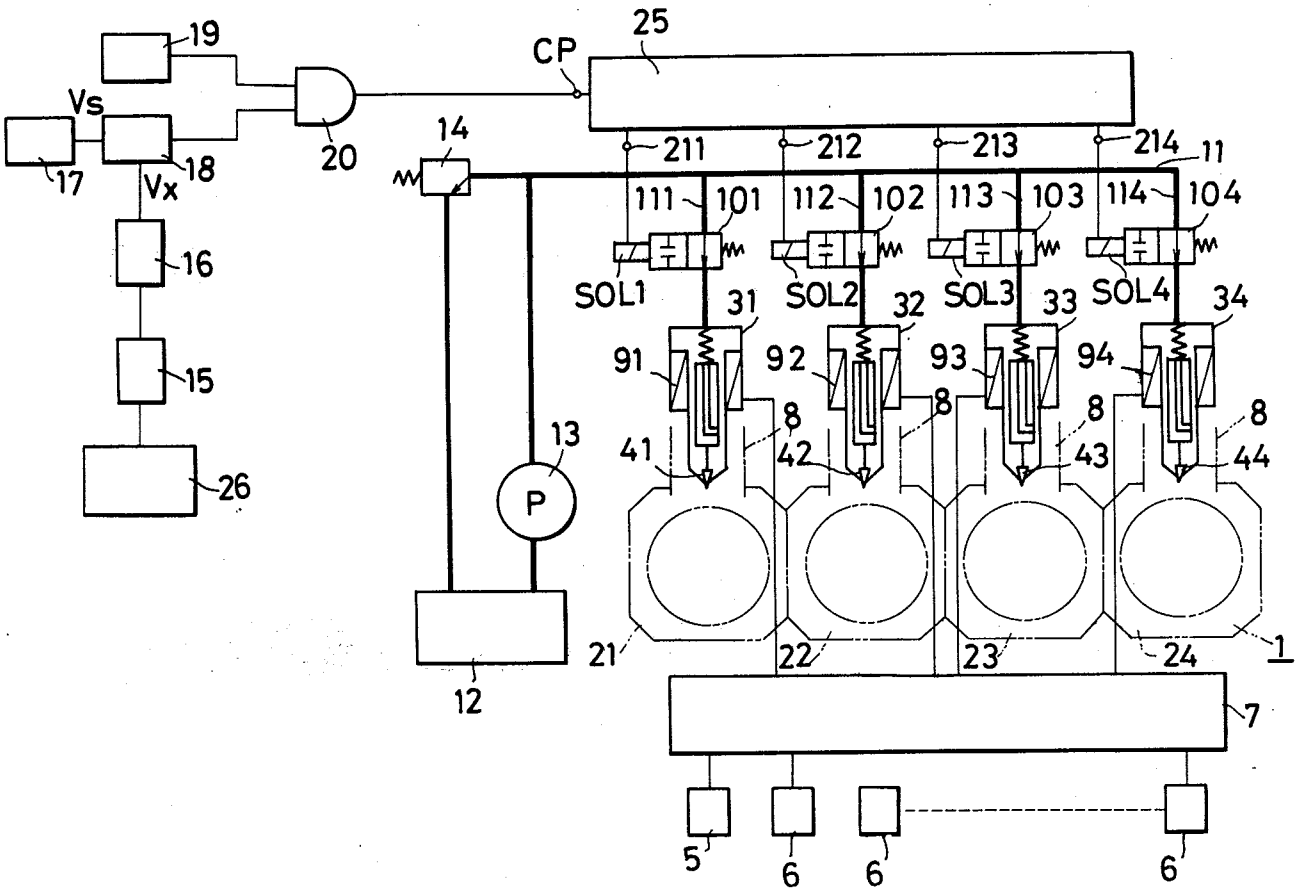
FIG. 1 is a block diagrammatic view showing a preferred embodiment of this invention.

Referring to FIG. 1 of the drawings, an internal combustion engine of an automobile is schematically shown at 1 and comprises four cylinders 21, 22, 23 and 24 to each of which one of four outlet pipes 8 of an intake manifold is connected. Each of the four outlet pipes 8 is provided with a fuel injection nozzle 31, 32, 33 or 34 having a needle valve 41, 42, 43 or 44. Each fuel injection nozzle 31, 32, 33 or 34 is provided with a solenoid 91, 92, 93 or 94 adapted to operate the needle valve 41, 42, 43 or 44. The solenoids 91 to 94 are electrically connected to a computer 7 of an electronically controlled fuel injection system. The computer 7 is connected with a distributor 5 and a plurality of sensors 6 provided for detecting the operating conditions of the engine and weather. The computer 7 receives signals from the distributor 5 and the sensors 6, determines the optimum timing and duration of fuel injection for any particular operating condition of the automobile in response to the signals received from the distributor 5 and the sensors 6 and transmits signals to the solenoids 91 to 94 to allow them to operate the corresponding needle valves 41 to 44 in a manner reflecting the optimum fuel injection timing and duration determined by the computer 7. Each fuel injection nozzle 31 to 34 is connected to a solenoid valve 101, 102, 103 or 104, and each of the solenoid valves 101 to 104 is connected with a branch fuel pipe 111, 112, 113 or 114. The branch fuel pipes 111 to 114 are connected to a main fuel pipe 11 connected to a fuel pump 13, which is in turn connected to a fuel tank 12. The main fuel pipe 11 is also connected with a fuel pressure regulator 14 which, in combination with the fuel pump 13, maintains the pressure of the fuel in the main fuel pipe 11 and the branch fuel pipes 111 to 114 at a predetermined level, for example, 2 kg/cm$^2$.

Figure 2:
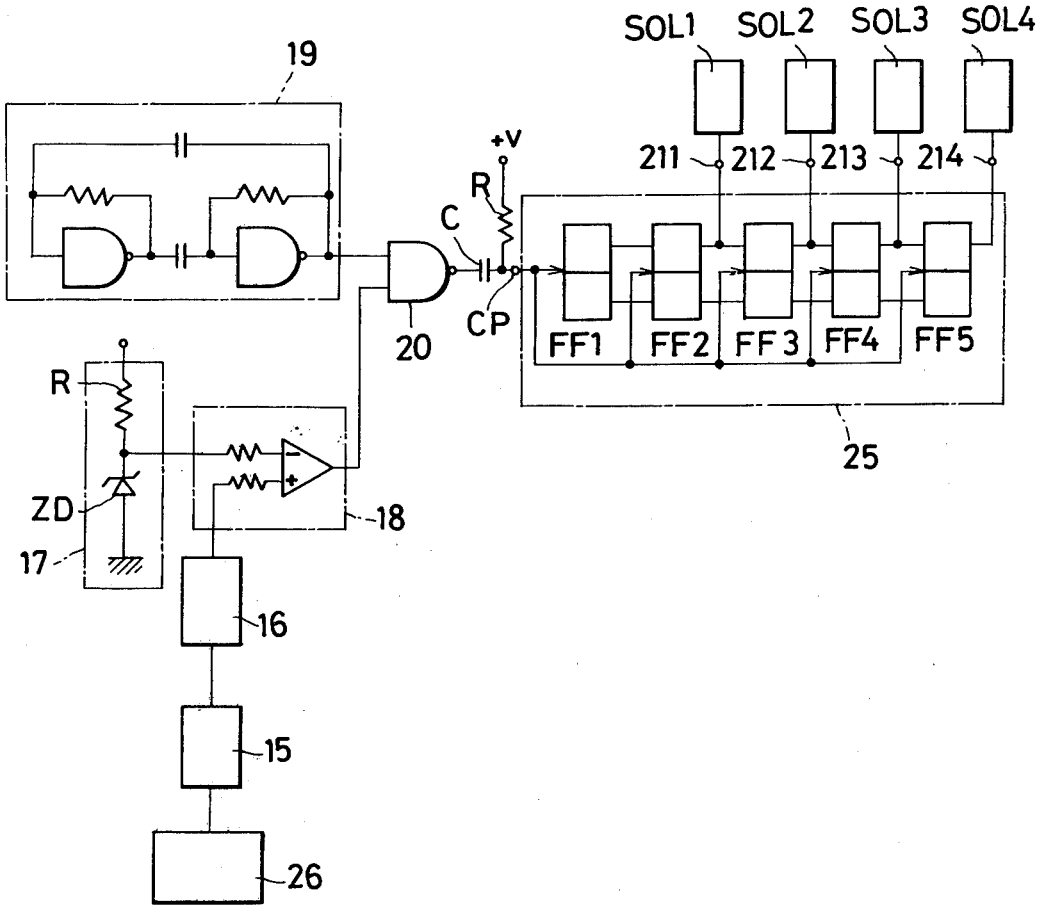
FIG. 2 is a diagram representing an electric circuit for the apparatus shown in FIG. 1.

A catalytic exhaust gas purifier 26 is provided on the exhaust side of the engine 1 and a temperature detecting sensor 15 is connected to the purifier 26 to detect the temperature thereof. The output signal of the temperature detecting sensor 15 is transmitted to a temperature-voltage transducer 16, in which the temperature of the purifier 26 is transduced to a voltage $Vx$. The output voltage $Vx$ is inputted to a comparator 18, to which a reference voltage $Vs$ is also inputted by a reference voltage generator 17. The reference voltage generator 17 includes a Zener diode ZD and a resistance R as shown in FIG. 2, which set the reference voltage $Vs$ at a level corresponding to the maximum allowable temperature for the catalytic purifier 26. When the output voltage $Vx$ of the transducer 16 exceeds the reference voltage $Vs$, the output of the comparator 18 is 1 and is inputted to an AND gate 20, to which there is also inputted the output of an oscillator 19 adapted to produce pulses at intervals corresponding to the length of time between variation in the flow of fuel through any particular fuel injection nozzle 31, 32, 33 or 34 and the resultant variation in the temperature of the catalytic purifier 26. When the output of the comparator 18 is 1, the AND gate 20 permits the output pulse of the oscillator 19 to pass to a differentiation circuit comprising a resistance R and a condenser C and then to a clock terminal CP of a multiplexer 25. The multiplexer 25 comprises a 5-bit shift register consisting of five clocked JK flip-flops FF1, FF2, FF3, FF4 and FF5 as shown in FIG. 2. The output terminals 211, 212, 213 and 214 of the multiplexer 25 are connected to the solenoids SOL1, SOL2, SOL3 and SOL4 of the solenoid valves 101, 102, 103 and 104, respectively. Each time the clock terminal CP receives a pulse from the oscillator 19, the signal set on the flip-flop FF1 when the operation of the engine 1 is started is shifted progressively through the flip-flops FF2, FF3, FF4 and FF5 to alternately produce an output in one of the output terminals 211 to 214 of the multiplexer 25, whereby one of the solenoids SOL1 to SOL4 is energized to stop the supply of fuel to the corresponding fuel injection nozzle 31, 32, 33 or 34. The flip-flop operations of the multiplexer 25 continue until after the fuel injection nozzle of which the needle valve has got out of order or the fuel injection nozzle associated with the engine cylinder which has misfired is located and the output voltage $Vx$ of the transducer 16 has become equal to or lower than the reference voltage $Vs$.

In operation, a signal is inputted to the flip-flop FF1 when an ignition switch (not shown) is actuated to start the operation of the engine 1. Insofar as the engine 1 is started from cold, the catalytic purifier 26 remains at a low temperature and the output voltage $Vx$ of the transducer 16 remains lower than the reference voltage $Vs$. Accordingly, the output of the comparator 18 is 0 and the AND gate 20 does not allow any pulse to pass from the oscillator 19 to the multiplexer 25, so that all the solenoid valves 101 to 104 remain open as shown in FIG. 1. Accordingly, the needle valves 41 to 44 open and close the respective fuel injection nozzles 31 to 34 to supply fuel into the respective cylinders 21 to 24 in accordance with the optimum timing and duration (rating) which are determined by the computer 7 in response to the signals received from the distributor 5 and the sensors 6, so that the engine 1 may be operated under the optimum conditions at all times. As the engine 1 is operated, the exhaust gas therefrom raises the temperature of the catalytic purifier 26, but since the exhaust gas does not yet contain a large quantity of uncombusted fuel, the temperature of the purifier 26 is still low enough to maintain the output voltage $Vx$ of the transducer 16 below the reference voltage $Vs$. Accordingly, no pulse is inputted from the oscillator 19 to the clock terminal CP of the multiplexer 25, but all the solenoid valves 101 to 104 remain open and allow the nozzles 31 to 34 to inject fuel at the optimum timing and rating for any particular operating condition of the automobile.

As the engine operation further proceeds, it may happen that one of the fuel injection nozzles gets out of order. Suppose that the needle valve 42 of the fuel injection nozzle 32 has failed to close properly. Fuel continues to be supplied through the nozzle 32 into the corresponding cylinder 22 when the cylinder 22 does not need any additional fuel. The excess fuel thus supplied does not burn in the cylinder 22, but is carried over into the catalytic purifier 26 with the exhaust gas from the other three cylinders. Thus, additional combustion takes place in the catalytic purifier 26 and increases the temperature thereof considerably. As the excess fuel content in the exhaust gas increases to a certain level, the temperature of the purifier 26, which is detected by the sensor 15, becomes so high that the output voltage $Vx$ of the transducer 16 exceeds the reference voltage $Vs$ from the generator 17. The output of the comparator 18 changes from 0 to 1 and the AND gate 20 permits a first pulse to pass from the oscillator 19 to the clock terminal CP of the multiplexer 25. The first pulse inputted to the clock terminal CP causes the signal set on the flip-flop FF1 to be shifted to the flip-flop FF2, so that an output appears at the output terminal 211 of the multiplexer 25 to energize the solenoid SOL1 to close the solenoid valve 101, whereby the supply of fuel to the fuel injection nozzle 31 is stopped. Inasmuch as it is not the nozzle 31 that is out of order, however, stopping the fuel supply to the nozzle 31 does not change the situation at all, but excess uncombusted fuel continues to flow into the exhaust gas and the temperature of the purifier 26 further increases. Accordingly, the output of the comparator 18 remains 1, and the AND gate 20 allows a second pulse to pass from the oscillator 19 to the clock terminal CP of the multiplexer 25. The signal set on the flip-flop FF2 is shifted to the flip-flop FF3, and while the output ceases to be present at the output terminal 211 of the multiplexer 25, an output is generated at the output terminal 212. The solenoid SOL1 is deenergized to open the solenoid valve 101 and the supply of fuel to the nozzle 31 is resumed. Instead, the solenoid SOL2 is energized to close the solenoid valve 102, whereby the supply of fuel to the nozzle 32 is stopped. Thus, no fuel is supplied through the nozzle 32 even if the needle valve 42 fails to close properly, and while the cylinder 22 associated with the nozzle 32 is inoperative, the other three cylinders 21, 23 and 24 continue to perform their normal cyclic operations to maintain the engine 1 in operation. The uncombusted fuel content in the exhaust gas is quickly reduced to a substantially normal level as if all the four cylinders 21 to 24 were performing their normal cyclic operations. The temperature of the purifier 26 is lowered to a normal level and the output voltage $Vx$ of the transducer 16 becomes lower than the reference voltage $Vs$. Thus, the output of the comparator 18 changes from 1 to 0 and the AND gate 20 does not allow a third or any further pulses to pass from the oscillator 19 to the clock terminal CP, so that the multiplexer 25 continues to generate an output at the output terminal 212 to maintain the solenoid SOL2 in its energized position to keep the solenoid valve 102 closed. A reset signal may be applied to the multiplexer 25 to open the solenoid valve 102 when the nozzle 32 has been repaired or has otherwise restored its normal function.

Figure 3:
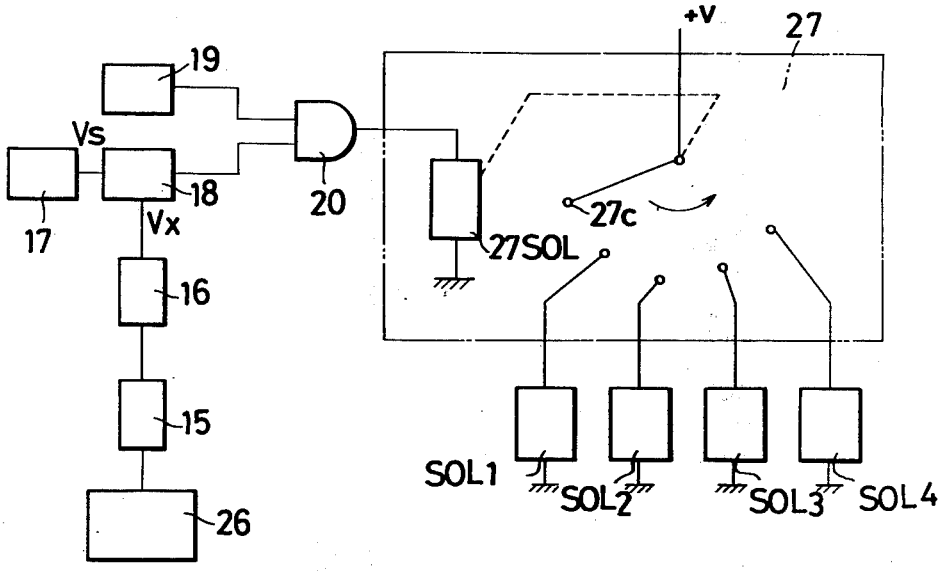
FIG. 3 is a block diagram representing another embodiment of this invention.

Referring now to FIG. 3, the same results may be obtained if the multiplexer 25 described with reference to FIGS. 1 and 2 is replaced by a pulse operated rotary switch 27. The rotary switch 27 comprises a movable contact 27*c*, and a solenoid 27SOL electrically connected to the AND gate 20. When the temperature of the catalytic purifier 26 rises above its maximum allowable level and the output voltage $Vx$ of the transducer 16 exceeds the reference voltage Vs, the output of the comparator 18 changes from 0 to 1 and the AND gate 20 allows a first pulse to pass from the oscillator 19 to the solenoid 27SOL of the rotary switch 27. The movable contact 27c is rotated in the direction indicated by an arrow in FIG. 3 and brought into contact with the solenoid SOL1 to close the solenoid valve 101, whereupon the supply of fuel to the fuel injection nozzle 31 is stopped. If the nozzle 31 is not the one that is out of order, however, the closure of the solenoid valve 101 does not result in lowering of the temperature of the purifier 26 to a normal level, but the output of the comparator 18 remains 1. The AND gate 20 thus allows a second pulse to pass from the oscillator 19 to the solenoid 27SOL and shift the movable contact 27c into contact with the solenoid SOL2 to close the solenoid valve 102, while the solenoid valve 101 is opened. The alternating actuation of the solenoids SOL1 to SOL4 is thus repeated until the defective nozzle is located, i.e., until closure of one of the solenoid valves 101 to 104 results in lowering of the purifier temperature to the extent that the output of the comparator 18 changes from 1 to 0, whereupon the movable contact 27c discontinues its rotary movement and remains in contact with the solenoid of the solenoid valve associated with the defective nozzle. A reset signal may be applied to the rotary switch 27 upon repair of the defective nozzle, whereby the movable contact 27c is brought back to its initial position shown in FIG. 3 and the normal supply of fuel is resumed through all the fuel injection nozzles 31 to 34.

Figure 4:
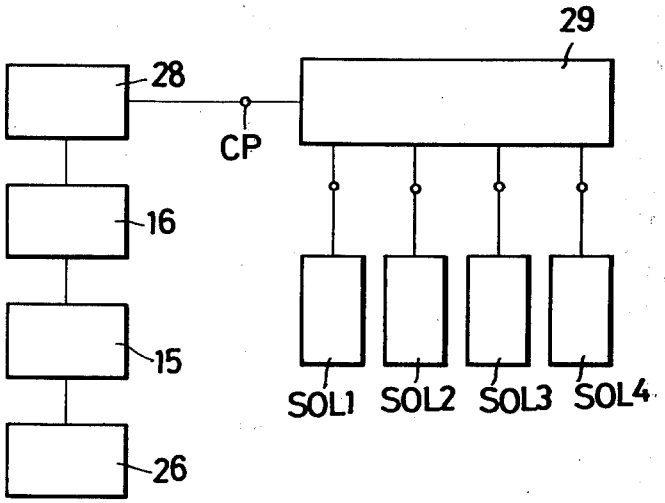
FIG. 4 is a block diagram representing still another embodiment of this invention.

An alternative arrangement illustrated in FIG. 4 includes a Schmitt circuit 28 connected to the output of the transducer 16 to be triggered by the output voltage thereof upon elevation of the temperature of the catalytic purifier 26 above a predetermined level. The arrangement further includes a multi-setting time limit relay 29 connected to the output of the Schmitt circuit 28. The relay 29 includes a plurality of contacts each adapted for establishing and interrupting an electric circuit through one of the solenoids SOL1 to SOL4 when an output signal is received from the Schmitt circuit 28. When a first signal is inputted to the relay 29, a first contact of the relay 29 establishes circuit continuity through the solenoid SOL1 to close the solenoid valve 101, whereby the supply of fuel to the fuel injection nozzle 31 is interrupted. If it is not the nozzle 31 that is out of order, however, closure of the solenoid valve 101 does not result in lowering of the purifier temperature, but the Schmitt circuit 28 inputs a second signal to the relay 29, whereupon a second contact of the relay 29 establishes circuit continuity through the solenoid SOL2, while the circuit continuity through the solenoid SOL1 is interrupted. This successive establishment and interruption of circuit continuity is continued through the solenoids SOL1 to SOL4 until the defective nozzle is located, all in a similar manner to those described in connection with the arrangements of FIGS. 1 and 2, and FIG. 3. It is an advantage of the arrangement of FIG. 4 that the time intervals of actuation of the solenoid valves 101 to 104 can be selected as desired in accordance with the temperature lowering characteristics of the catalytic purifier 26.

While the invention has been described with reference to several embodiments thereof, it is to be understood that further variations or modifications may be made by those skilled in the art without departing from the scope of the invention which is defined by the appended claims.

What is claimed is:

1. In a fuel control apparatus for an automobile engine equipped with an electronically controlled fuel injection system; and a catalytic exhaust gas purifying system, said fuel injection system including a plurality of sensors to detect the operating conditions of said automobile engine and changes in the weather and transmit signals to an electronic computer, said computer including means to determine the optimum timing and rating of fuel injection in accordance with said signals received from said sensors, a plurality of fuel injection nozzles each associated with at least one of a plurality of cylinders of said engine, and means for supplying fuel under pressure from a source of fuel supply to each of said fuel injection nozzles, said means for supplying including a plurality of fuel distributing pipes each leading to one of said fuel injection nozzles, wherein the improvement comprises:

a plurality of solenoid valves, each provided in one of said fuel distributing pipes, to supply fuel to one of said fuel injection nozzles upon opening and discontinue supply of fuel thereto upon closure;

means for generating and transmitting a signal when the temperature of said purifying system exceeds a predetermined level, including an AND gate for gating a control pulse and a condenser and resistor to differentiate said control pulse, thereby producing the transmitted signal; and electric control means including a multiplexer responsive to said differentiated control pulse to selectively close said solenoid valves and stop the selective closing of said solenoid valves holding the condition that one of said solenoid valves is closed and the others of said valves are opened when the temperature of said purifying system is lower than a predetermined level.

2. In combination with an automobile engine equipped with an electronically controlled fuel injection system; and a catalytic exhaust gas purifying system, said fuel injection system including a plurality of sensors to detect the operating conditions of said automobile engine and changes in the weather and transmit signals to an electronic computer, said computer including means to determine the optimum timing and rating of fuel injection in accordance with said signals received from said sensors, a plurality of fuel injection nozzles each associated with at least one of a plurality of cylinders of said engine, and means for supplying fuel under pressure from a source of fuel supply to each of said fuel injection nozzles, said means for supplying including a plurality of fuel distributing pipes each leading to one of said fuel injection nozzles, wherein the improvement comprises:

a plurality of solenoid valves, each provided in one of said fuel distributing pipes, to supply fuel to one of said fuel injection nozzles upon opening and discontinue supply of fuel thereto upon closure;

means for generating and transmitting a signal when the temperature of said purifying system exceeds a predetermined level, comprising a sensor to detect the temperature of said purifying system and transmit a signal to a temperature-to-voltage transducer, said transducer including means to convert said signal of said purifying system temperature sensor to a voltage signal, a comparator to receive said voltage signal from said transducer and compare said voltage signal with a reference voltage signal corresponding to said predetermined level of temperature of said purifying system, means for generating said reference voltage signal and inputting it to said comparator, oscillator means for generating a pulse at predetermined time intervals, and an AND gate to receive an output of said comparator and said pulse from said oscillator means, and allow said pulse to pass to an electric control means, depending upon said output of said comparator; and electric control means to selectively close said solenoid valves in response to said pulse from said AND gate and stop the selective closing of said solenoid valves holding the condition that one of said solenoid valves is closed and the others of said valves are opened when the temperature of said purifying system is lower than a predetermined level.

3. Apparatus as defined in claim 2 wherein said electric control means is a multiplexer comprising:

a shift register comprising a clock terminal and a number of clocked JK flip-flops each connected to said clock terminal, said clock terminal being electrically connected to said signal generating and transmitting means, said number of said flip-flops being equal to the number of said fuel injection nozzles plus one; and a plurality of output terminals each connected to one of said solenoid valves.

4. Apparatus as defined in claim 3 further comprising a differentiating circuit including a resistance and a condenser connected between said generating and transmitting means and said clock terminal.

* * * * *